US012044431B2

(12) United States Patent
Martin, Sr.

(10) Patent No.: US 12,044,431 B2
(45) Date of Patent: Jul. 23, 2024

(54) ENCLOSURES FOR AIR SYSTEMS, AIR SYSTEMS HAVING ENCLOSURES, AND METHODS OF USING ENCLOSURES

(71) Applicant: Cody Martin, Cypress, TX (US)

(72) Inventor: Lendell Martin, Sr., Cypress, TX (US)

( * ) Notice: Subject to any disclaimer, the term of this patent is extended or adjusted under 35 U.S.C. 154(b) by 0 days.

(21) Appl. No.: 17/526,381

(22) Filed: Nov. 15, 2021

(65) Prior Publication Data

US 2022/0154971 A1 May 19, 2022

Related U.S. Application Data

(60) Provisional application No. 63/205,109, filed on Nov. 16, 2020.

(51) Int. Cl.

| | |
|---|---|
| ***F24F 13/20*** | (2006.01) |
| ***F24F 7/06*** | (2006.01) |
| ***F24F 13/30*** | (2006.01) |

(52) U.S. Cl.

CPC ..... *F24F 13/20* (2013.01); *F24F 7/065* (2013.01); *F24F 13/30* (2013.01); *F24F 2013/205* (2013.01)

(58) Field of Classification Search

CPC ..... F24F 13/20; F24F 13/30; F24F 2013/205; F24F 7/065

See application file for complete search history.

(56) References Cited

U.S. PATENT DOCUMENTS

| | | | |
|---|---|---|---|
| 2,740,268 | A | 4/1956 | Jones |
| 2,780,445 | A | 2/1957 | Rimbach |
| 2,995,906 | A | 8/1961 | Brandimarte |
| 3,020,820 | A | 2/1962 | Hopkinson et al. |
| 3,174,541 | A | 3/1965 | Brandt et al. |
| 3,213,936 | A | 10/1965 | Tull |
| 3,299,660 | A | 1/1967 | Sullivan |
| 3,313,342 | A | 4/1967 | Laing |
| 3,372,870 | A | 3/1968 | Norris et al. |
| 3,405,758 | A | 10/1968 | Walker et al. |
| 3,411,569 | A | 11/1968 | Hildreth |
| D219,450 | S | 12/1970 | Ortega et al. |
| 3,583,175 | A | 6/1971 | Eubank |
| 3,601,116 | A | 8/1971 | Davis |
| 3,653,431 | A | 4/1972 | Loveley |
| 3,672,349 | A | 6/1972 | Derringer |

(Continued)

FOREIGN PATENT DOCUMENTS

| | | | | |
|---|---|---|---|---|
| EP | 1795819 A1 * | 6/2007 | ..... | F24F 1/0007 |
| JP | 2017110834 A * | 6/2017 | | |

OTHER PUBLICATIONS

AllStyle Coil Company, L.P.'s 2017 Brochure. https://www.allstyle.com/images/pdfs/LM20020-D--AB-SERIES-INSTALLATION-GUIDE.pdf (12 pages). Jan. 2018.

*Primary Examiner* — Edelmira Bosques
*Assistant Examiner* — Michael James Giordano
(74) *Attorney, Agent, or Firm* — McCutcheon Joseph, PLLC

(57) ABSTRACT

An air system includes an enclosure including walls; and selectively removable opening sections on one or more of the walls. Each of the selectively removable opening sections comprises a part that is selectively removable to create an air flow passageway out of the enclosure. The air system and/or enclosure is thus adaptable for different configurations of air flow.

20 Claims, 9 Drawing Sheets

(56) References Cited

U.S. PATENT DOCUMENTS

| | | | |
|---|---|---|---|
| 3,685,577 | A | 8/1972 | Goodgion et al. |
| 3,716,097 | A | 2/1973 | Kelp et al. |
| 3,722,845 | A | 3/1973 | Unger |
| 3,759,321 | A | 9/1973 | Ares |
| D230,153 | S | 1/1974 | Hoyle et al. |
| D230,981 | S | 3/1974 | Dupler et al. |
| 3,985,115 | A | 10/1976 | McVicker et al. |
| 4,035,610 | A | 7/1977 | Roth |
| 4,129,013 | A | 12/1978 | Hine, Jr. |
| D251,438 | S | 3/1979 | Dowdall |
| D252,526 | S | 7/1979 | DeNyse |
| D260,283 | S | 8/1981 | Cagle |
| D262,650 | S | 1/1982 | McConkey |
| 4,321,803 | A | 3/1982 | Smith |
| 4,337,823 | A | 7/1982 | DelPercio |
| 4,409,955 | A | 10/1983 | Christian |
| 4,434,782 | A | 3/1984 | Traeger |
| 4,466,358 | A | 8/1984 | Christian |
| 4,474,232 | A | 10/1984 | Wright et al. |
| 4,511,786 | A | 4/1985 | Jansen |
| 4,523,081 | A | 6/1985 | Geib, Sr. et al. |
| 4,644,135 | A | 2/1987 | Daily |
| 4,665,806 | A | 5/1987 | Martin, Sr. |
| 4,671,076 | A | 6/1987 | Duren |
| 4,698,982 | A | 10/1987 | Laios et al. |
| 4,748,827 | A | 6/1988 | Chang |
| 4,924,848 | A | 5/1990 | Vaughn |
| 5,062,280 | A | 11/1991 | Martin, Sr. |
| 5,067,560 | A | 11/1991 | Carey et al. |
| 5,097,678 | A | 3/1992 | Aubuchon |
| 5,121,613 | A | 6/1992 | Cox et al. |
| 5,143,178 | A | 9/1992 | Latham, Jr. |
| 5,203,400 | A | 4/1993 | Tsunekawa et al. |
| 5,207,074 | A | 5/1993 | Cox et al. |
| 5,228,197 | A | 7/1993 | Cox et al. |
| 5,279,360 | A | 1/1994 | Hughes et al. |
| 5,284,027 | A | 2/1994 | Martin, Sr. |
| 5,293,860 | A | 3/1994 | Tomlinson et al. |
| 5,341,796 | A | 8/1994 | Beck et al. |
| 5,341,870 | A | 8/1994 | Hughes et al. |
| 5,345,924 | A | 9/1994 | Rieke et al. |
| 5,347,980 | A | 9/1994 | Shellenberger |
| D353,883 | S | 12/1994 | Blanchard |
| 5,379,832 | A | 1/1995 | Dempsey |
| D357,309 | S | 4/1995 | Norris |
| 5,501,269 | A | 3/1996 | Jenkins |
| 5,613,554 | A | 3/1997 | Bull et al. |
| 5,664,431 | A | 9/1997 | Martin, Sr. |
| 5,699,854 | A | 12/1997 | Hong |
| 5,765,544 | A | 6/1998 | Vigansky, Jr. |
| 5,791,156 | A | 8/1998 | Strautman et al. |
| 5,927,096 | A | 7/1999 | Piccione |
| 5,947,195 | A | 9/1999 | Sasaki |
| 5,961,093 | A | 10/1999 | Jones et al. |
| 5,987,909 | A | 11/1999 | Martin, Sr. |
| 6,021,775 | A | 2/2000 | Dempsey et al. |
| 6,050,539 | A | 4/2000 | Millen |
| D427,302 | S | 6/2000 | Mills et al. |
| 6,138,993 | A | 10/2000 | Mitchell, Jr. et al. |
| D434,480 | S | 11/2000 | Caronna et al. |
| 6,276,443 | B1 | 8/2001 | Martin, Sr. |
| 6,311,735 | B1 | 11/2001 | Small, Sr. et al. |
| 6,332,411 | B1 | 12/2001 | Skrotskaya et al. |
| 6,378,320 | B1 | 4/2002 | Matambo et al. |
| 6,394,794 | B2 | 5/2002 | Bloom et al. |
| 6,457,653 | B1 | 10/2002 | Campbell |
| 6,516,140 | B2 | 2/2003 | Arnold et al. |
| 6,519,966 | B1 | 2/2003 | Martin, Sr. |
| D484,897 | S | 1/2004 | Hohenshelt et al. |
| 6,692,688 | B2 | 2/2004 | Contrucci et al. |
| D529,157 | S | 9/2006 | Tice et al. |
| D534,260 | S | 12/2006 | David et al. |
| D534,630 | S | 1/2007 | David et al. |
| D534,635 | S | 1/2007 | David et al. |
| D534,636 | S | 1/2007 | David et al. |
| 7,185,513 | B2 | 3/2007 | Bush et al. |
| D553,725 | S | 10/2007 | Shimizu |
| D557,394 | S | 12/2007 | Martin, Sr. et al. |
| D557,395 | S | 12/2007 | Martin, Sr. et al. |
| 7,507,368 | B2 | 3/2009 | Kurita et al. |
| D603,495 | S | 11/2009 | Sata et al. |
| D603,948 | S | 11/2009 | Ishihara |
| 7,614,248 | B2 | 11/2009 | Lee et al. |
| 7,757,510 | B2 | 7/2010 | Rosete et al. |
| D623,280 | S | 9/2010 | Bartlett et al. |
| D629,091 | S | 12/2010 | Maezawa et al. |
| 7,921,904 | B2 | 4/2011 | Matter et al. |
| D638,529 | S | 5/2011 | Gedcke et al. |
| D683,002 | S | 5/2013 | Martin, Sr. |
| 8,769,979 | B2 | 7/2014 | Timbs et al. |
| 8,910,492 | B2 | 12/2014 | Ikeda et al. |
| 9,086,243 | B2 | 7/2015 | Komori et al. |
| 9,086,245 | B2 | 7/2015 | Kitazawa et al. |
| 9,103,599 | B2 | 8/2015 | Lee et al. |
| 9,115,939 | B2 | 8/2015 | Huazhao et al. |
| 9,267,702 | B2 | 2/2016 | Santini et al. |
| 9,303,882 | B2 | 4/2016 | Hancock |
| D755,942 | S | 5/2016 | Kim et al. |
| 9,328,939 | B2 | 5/2016 | Edens et al. |
| 9,404,669 | B2 | 8/2016 | Mercer et al. |
| D786,413 | S | 5/2017 | Martin, Sr. |
| 10,066,843 | B2 | 9/2018 | Hancock et al. |
| 10,132,572 | B2 | 11/2018 | Sakamaki et al. |
| 10,139,115 | B2 | 11/2018 | Lackie et al. |
| 10,180,285 | B2 | 1/2019 | Josserand et al. |
| 10,697,709 | B2 | 6/2020 | Chen et al. |
| 10,823,447 | B2 | 11/2020 | McKie et al. |
| 10,845,066 | B2 | 11/2020 | Hayakawa |
| 10,955,175 | B2 | 3/2021 | Berg et al. |
| 11,009,255 | B2 | 5/2021 | Morris |
| D927,664 | S | 8/2021 | Martin, Sr. |
| 2002/0139518 | A1 | 10/2002 | Lee et al. |
| 2005/0039479 | A1 | 2/2005 | Kim |
| 2005/0204767 | A1 | 9/2005 | Norrell et al. |
| 2007/0051864 | A1 | 3/2007 | Bartell et al. |
| 2008/0302120 | A1* | 12/2008 | Kang ..... F04D 25/064 62/259.1 |
| 2009/0038328 | A1 | 2/2009 | Piccione |
| 2010/0218534 | A1 | 9/2010 | Yabu et al. |
| 2011/0100051 | A1 | 5/2011 | Edens et al. |
| 2015/0114600 | A1 | 4/2015 | Chen et al. |
| 2015/0211782 | A1 | 7/2015 | Ikeda et al. |
| 2015/0267931 | A1 | 9/2015 | Ai et al. |
| 2019/0178548 | A1 | 6/2019 | Lin |
| 2021/0018234 | A1 | 1/2021 | Lingrey et al. |
| 2021/0033346 | A1 | 2/2021 | Yamada et al. |

* cited by examiner

ENCLOSURES FOR AIR SYSTEMS, AIR SYSTEMS HAVING ENCLOSURES, AND METHODS OF USING ENCLOSURES

CROSS REFERENCE TO RELATED APPLICATIONS

This application is a non-provisional application that claims priority to U.S. Provisional Application No. 63/205,109, filed on Nov. 16, 2020. The disclosure of the prior application is hereby incorporated by reference herein in its entirety.

TECHNICAL FIELD

The present disclosure relates to air systems that are adaptable for different configurations of air flow. In particular, the disclosure relates to an enclosure and air systems including an enclosure having selectively removable opening sections. Each of the selectively removable opening sections comprises a part that is selectively removable to create an air flow passageway out of the enclosure.

BACKGROUND

A wide variety of air systems are known. These include: air handling systems; air treatment systems; air heating systems; air cooling systems; and air conditioning systems. These air systems may include enclosures, housings, or opening structures. It is known to provide enclosures or housings with walls made of material such as sheet metal, fiber board, or wood. Such enclosures or housings can be cut in a desired location to provide an opening for air to flow out of the enclosure or housing.

SUMMARY

The present disclosure discusses embodiments that provide: air systems with an enclosure, box, housing or container (all herein collectively referred to as "enclosures"); enclosures themselves; and methods of using such a system and/or enclosures to provide air through one, two or three, or more of selected possible openings of the enclosure through which air is being blown by a blower. Such systems may include, but are not limited to, horizontal flow systems, up-flow systems, and down-flow systems.

In certain embodiments, the enclosure is a structure provided with multiple selectively removable opening sections, areas, portions, or parts (collectively "sections") which are formed integrally or connected to an enclosure.

In some embodiments, the enclosure has defined sections, one or a plurality of which can be selected for an opening. The defined sections may include a facilitating structure(s) to assist in the removal of the defined sections from the enclosure. These facilitating structures include: perforations, indentations, valleys, areas or lines of lessened thicknesses, weakened areas or lines, less stable and/or less strong areas of material as compared to adjacent material, or a combination thereof. The defined sections facilitate removal of material making up the area encompassed or encircled by the facilitating structure.

In some embodiments, the enclosure or structure may have a hole or series of holes with filler, plugging material, or an interior cover, which is selectively removable to permit air flow through the holes to provide an opening in a selected wall or portion of the enclosure or structure.

Accordingly, the present disclosure includes features and advantages which are believed to enable it to advance air handling technology, air treatment technology and air system enclosure and structure technology. Characteristics and advantages are described above, and additional features and benefits are discussed in the following detailed description and in the accompanying drawing figures.

Certain embodiments discussed herein are not limited to any particular individual feature disclosed here, but can include combinations of features. Some features of the embodiments have been broadly described so that the detailed descriptions that follow may be better understood, and in order that the contributions of this disclosure to the arts may be better appreciated. There are, of course, additional aspects of the embodiments described above and below which may be included in the subject matter of the claims to this application. The claims of this application are to be read to include any legally equivalent parts, elements, devices, combinations, processes, steps, or methods which do not depart from the spirit and scope of the present disclosure.

The present disclosure recognizes and addresses long-felt needs for effective and efficient air treatment systems and methods, and provides a solution to problems and a satisfactory meeting of those needs in its various possible embodiments and equivalents thereof. The following description of certain embodiments is given for the purpose of disclosure, when taken in conjunction with the accompanying drawings. The detail in these descriptions is not intended to thwart this patent's object to claim this invention no matter how others may later try to disguise it by superficial variations in form or insubstantial changes in an effort to avoid this patent's claims. It will be understood that the various embodiments of the present disclosure may include one, some, or all of the disclosed, described, and/or enumerated improvements and/or technical advantages and/or elements in claims to this invention.

In one embodiment, an air system comprises: an enclosure including walls; and selectively removable opening sections on one or more of the walls, wherein each of the selectively removable opening sections comprises a part that is selectively removable to create an air flow passageway out of the enclosure.

In an embodiment, the air system further comprises a blower within the enclosure.

In an embodiment, the air system further comprises an auxiliary structure including an air flow passageway for air blown by the blower to pass through the auxiliary structure and exit therefrom.

In an embodiment, the air system further comprises a coil within the enclosure.

In another embodiment, an enclosure for an air system comprises: walls; and selectively removable opening sections on one or more of the walls, wherein each of the selectively removable opening sections comprises a part that is selectively removable to create an air flow passageway out of the enclosure.

In an embodiment, the part is formed integrally with the enclosure.

In an embodiment, each of the selectively removable opening sections comprises a facilitating structure to assist with removal of the part from the enclosure.

In an embodiment, the facilitating structure comprises at least one of perforations, indentations, valleys, areas of lessened thickness, material that is less stable than material of the enclosure, and material that is weaker than material of the enclosure.

In an embodiment, the part is detachably connected to the enclosure via a fastener.

In an embodiment, the fastener comprises at least one of tape, glue, adhesive, a hook-and-loop system, friction fit, snap fit, and mating joint fit.

In an embodiment, the part comprises at least one of a cover, a plug, and a filler.

In a further embodiment, an enclosure for an air system comprises: a blower within the enclosure; a coil within the enclosure; an auxiliary structure including an air flow passageway for air blown by the blower to pass through the auxiliary structure and exit therefrom; walls; and selectively removable opening sections on one or more of the walls, wherein each of the selectively removable opening sections comprises a part that is selectively removable to create an air flow passageway out of the enclosure, wherein the part is formed integrally with the enclosure, and each of the selectively removable opening sections comprises a facilitating structure to assist with removal of the part from the enclosure, wherein the facilitating structure comprises at least one of perforations, indentations, valleys, areas of lessened thickness, material that is less stable than material of the enclosure, and material that is weaker than material of the enclosure, or the part is detachably connected to the enclosure via a fastener that comprises at least one of tape, glue, adhesive, a hook-and-loop system, friction fit, snap fit, and mating joint fit, and the part comprises at least one of a cover, a plug, and a filler.

In an additional embodiment, a method of creating an air flow passageway in an air system comprises: selectively removing at least one of a plurality of removable opening sections from one or more walls of an enclosure to provide an air flow passageway through the one or more walls so that air can flow out of the enclosure via the air flow passageway.

In an embodiment, the removable opening sections are formed integrally with the enclosure, and the method comprises permanently removing the at least one removable opening section.

In an embodiment, the at least one removable opening section is permanently removed via a facilitating structure that comprises at least one of perforations, indentations, valleys, areas of lessened thickness, material that is less stable than material of the enclosure, and material that is weaker than material of the enclosure.

In an embodiment, the removable opening sections are detachably connected to the enclosure, and the method comprises removing the at least one removable opening section via a fastener.

In an embodiment, the fastener comprises at least one of tape, glue, adhesive, a hook-and-loop system, friction fit, snap fit, and mating joint fit.

In an embodiment, each of the removable opening sections comprises at least one of a cover, a plug, and a filler.

In another further embodiment, method of creating an air flow passageway in an air system comprises: providing and enclosure that houses therein: a blower; a coil; and an auxiliary structure including an air flow passageway for air blown by the blower to pass through the auxiliary structure and exit therefrom; selectively removing at least one of a plurality of removable opening sections from one or more walls of the enclosure to provide an air flow passageway through the one or more walls so that air can flow out of the enclosure via the air flow passageway, wherein the removable opening sections are formed integrally with the enclosure, and the method comprises permanently removing the at least one removable opening section via a facilitating structure that comprises at least one of perforations, indentations, valleys, areas of lessened thickness, material that is less stable than material of the enclosure, and material that is weaker than material of the enclosure, or the removable opening sections are detachably connected to the enclosure, and the method comprises removing the at least one removable opening section via a fastener that comprises at least one of tape, glue, adhesive, a hook-and-loop system, friction fit, snap fit, and mating joint fit, wherein each of the removable opening sections comprises at least one of a cover, a plug, and a filler.

In an embodiment, the method further comprises: attaching the enclosure to a support; and mounting the enclosure to at least one of a ceiling and a wall via the support.

BRIEF DESCRIPTION OF THE FIGURES

Various embodiments are hereafter described in detail and with reference to the drawings wherein like reference characters designate like or similar elements throughout the several figures and views that collectively comprise the drawings. These drawings illustrate some, but not all, embodiments and are not to be used to improperly limit the scope of the invention which may have other equally effective, legally equivalent embodiments.

DETAILED DESCRIPTION

Figure 1A:
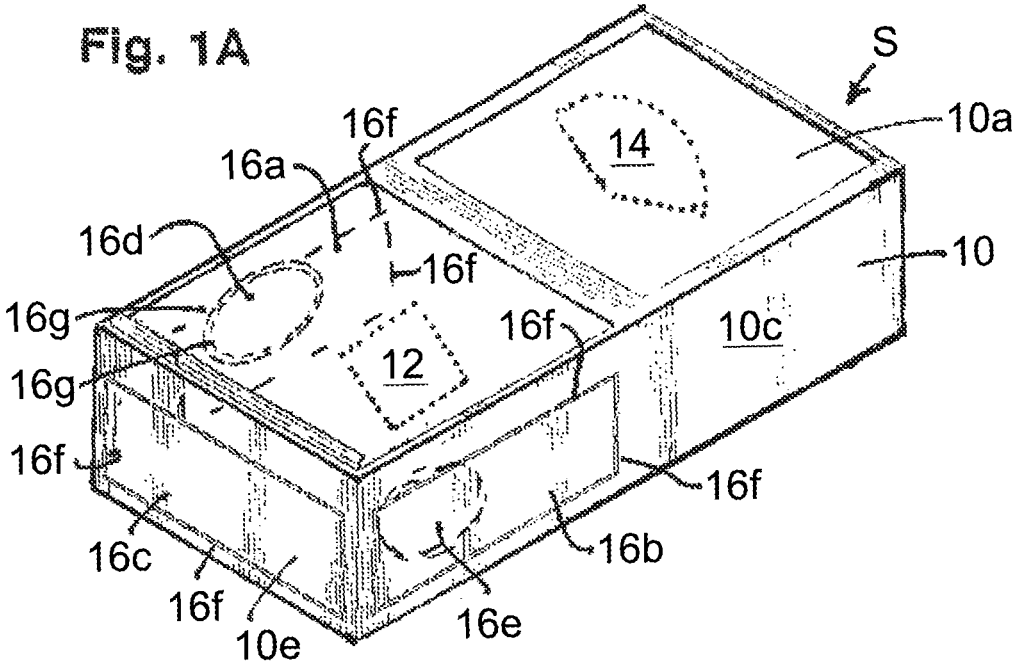
FIG. 1A is perspective view of an air system with an enclosure, according to an embodiment.

Before describing selected embodiments of the present disclosure in detail, it is to be understood that the present invention is not limited to the particular embodiments described herein. The disclosure and description herein is illustrative and explanatory of one or more embodiments and variations thereof, and it will be appreciated by those skilled in the art that various changes in the design, organization, means of operation, structures and location, methodology, and use of mechanical equivalents may be made without departing from the spirit of the invention.

It should also be understood that the drawings are intended to illustrate and plainly disclose embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Certain embodiments of the present disclosure are shown in the above-identified figures and described in detail below. Any combination of aspects and/or features described below can be used except where such aspects and/or features are mutually exclusive. So long as they are not mutually exclusive or contradictory, any aspect, element, step, or feature or combination of aspects, etc., of any embodiment disclosed herein may be used in any other embodiment disclosed herein. For example, if an embodiment with features, elements, steps, or aspects A, B, C, and D is disclosed, and an embodiment with features, elements, steps, and/or aspects A, B, D is possible within the scope of this invention, then the embodiment with A, B, D is part of this disclosure as an embodiment of the present invention; and so forth for all possible combinations of features, elements, steps, and/or aspects.

It should be understood that the appended drawings and description herein are of certain embodiments and are not intended to limit the invention. On the contrary, the intention is to cover all modifications, additions, embodiments, equivalents and alternatives falling within the spirit and scope of the invention as defined by the appended claims.

In showing and describing these embodiments, like or identical reference numerals are used to identify common or similar elements. The figures are not necessarily to scale and certain features and certain views of the figures may be shown exaggerated in scale or in schematic in the interest of clarity, conciseness, and disclosure.

As used herein and throughout all the various portions (and headings) of this disclosure, the terms "invention", "present invention" and variations thereof mean one or more embodiments, and are not intended to mean the claimed invention of any particular embodiment. Accordingly, the subject or topic of each such reference is not automatically or necessarily part of, or required by, any particular embodiment.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Throughout this disclosure, words and terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The term "about" as used herein can allow for a degree of variability in a value or range, for example, within 10%, within 5%, or within 1% of a stated value or of a stated limit of a range. In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation.

Any use of section headings is intended to aid reading of the document and is not to be interpreted as limiting. Information that is relevant to a section heading may occur within or outside of that particular section.

In any method herein, the steps can be carried out in any order without departing from the principles of the invention, except when a temporal or operational sequence is explicitly recited. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Figure 1B:
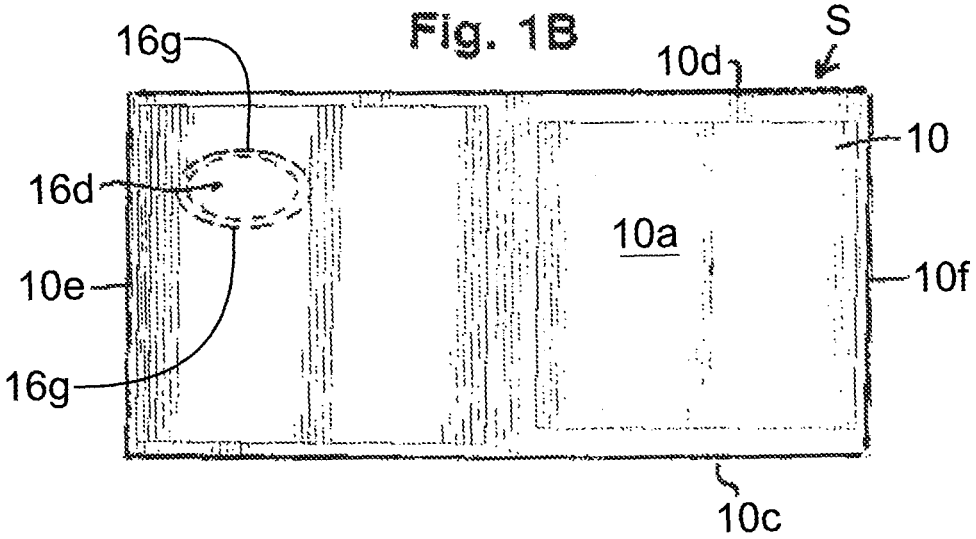
FIG. 1B is a top view of the air system and enclosure of FIG. 1A according to an embodiment.
Figure 1C:
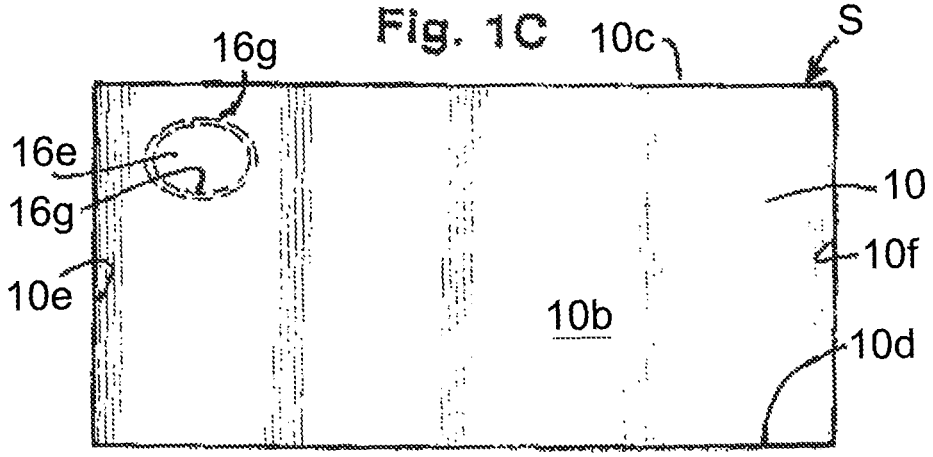
FIG. 1C is a bottom view of the air system and enclosure of FIG. 1A according to an embodiment.

Referring now to FIGS. 1A-1C, an air system S according to one embodiment includes an enclosure 10 which has a top 10*a*, a bottom 10*b*, sides 10*c* and 10*d*, a front end 10*e*, and a back end 10*f*, each forming a wall of the enclosure 10. The air system S can include any suitable internal structures, devices and apparatuses for air systems. For instance, the air system S may include (shown schematically in dotted lines in FIG. 1A) a blower 12 (or blower system with, e.g., controls, a motor, a power source, sensors, conduits, pipes, and/or seals) and a coil 14 (or coil system with, e.g., controls, pump(s), sensors, conduits, pipe(s), drain(s), pan(s) and/or seals). The enclosure 10 may be formed of materials such as, but not limited to, sheet metal, fiber board, and wood, in some embodiments.

The enclosure 10 includes a plurality of sections 16*a*-16*e* that are removable to each provide an exit flow path for air blown by the blower 12 to exit from the enclosure 10. Facilitating structures 16*f*-16*g* may be provided to ease the selective removal of such sections. The facilitating structures 16*f*-16*g* may be, e.g., reduced thickness areas or lines, weakened areas or lines, valleys, indentations, holes, perforations, or combinations thereof, in the enclosure 10. It is to be noted that these various types of facilitating structures are not equivalent to each other in structure, shape, extent, all modes and manners of operation, all results achieved, or all functions, and they are provided, inter alia, to define the plurality of sections 16*a*-16*e*, to indicate their location, and to facilitate their removal (or bending aside) from a wall of the enclosure 10 where they are located. In the illustrated embodiment, sections 16*a*, 16*b*, and 16*c* are defined by a facilitating structure 16*f* that includes lines of perforations 16*f*. Such perforations 16*f* can be sized and located so that the sections 16*a*, 16*b*, and 16*c* may be easily torn from their respective walls; or so that the sections 16*a*, 16*b*, and 16*c* can be cut from their respective walls with a cutting tool. Sections 16*d* and 16*e* are encompassed by and defined by lines 16*g* on portions of the wall whose thickness is less than that of the adjacent wall areas, and which are sufficiently thin to facilitate removal of the sections 16*d* and 16*e*.

Figure 2A:
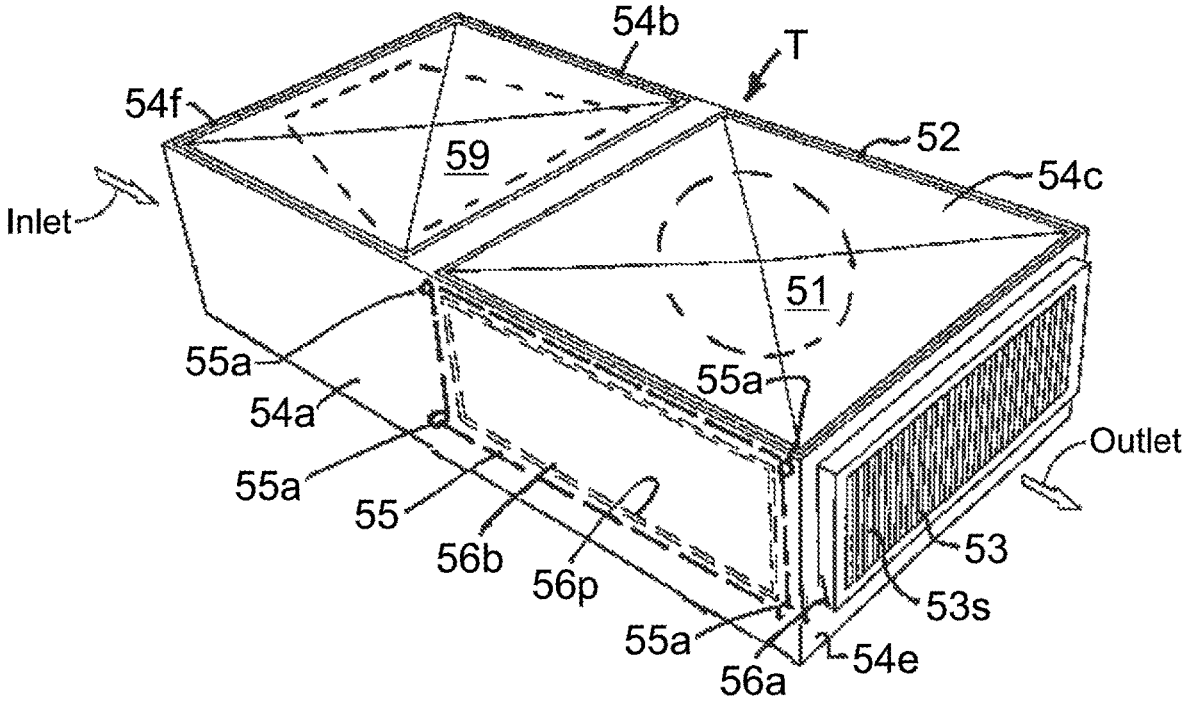
FIG. 2A is a perspective view of an air system with an enclosure, according to another embodiment.
Figure 2B:
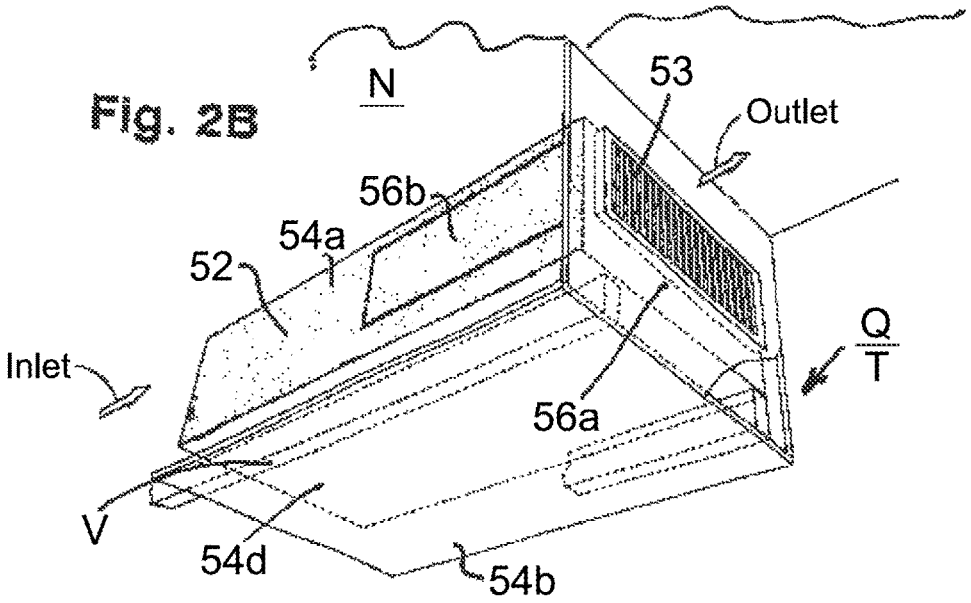
FIG. 2B is bottom view of the air system of FIG. 2A according to an embodiment.
Figure 2C:
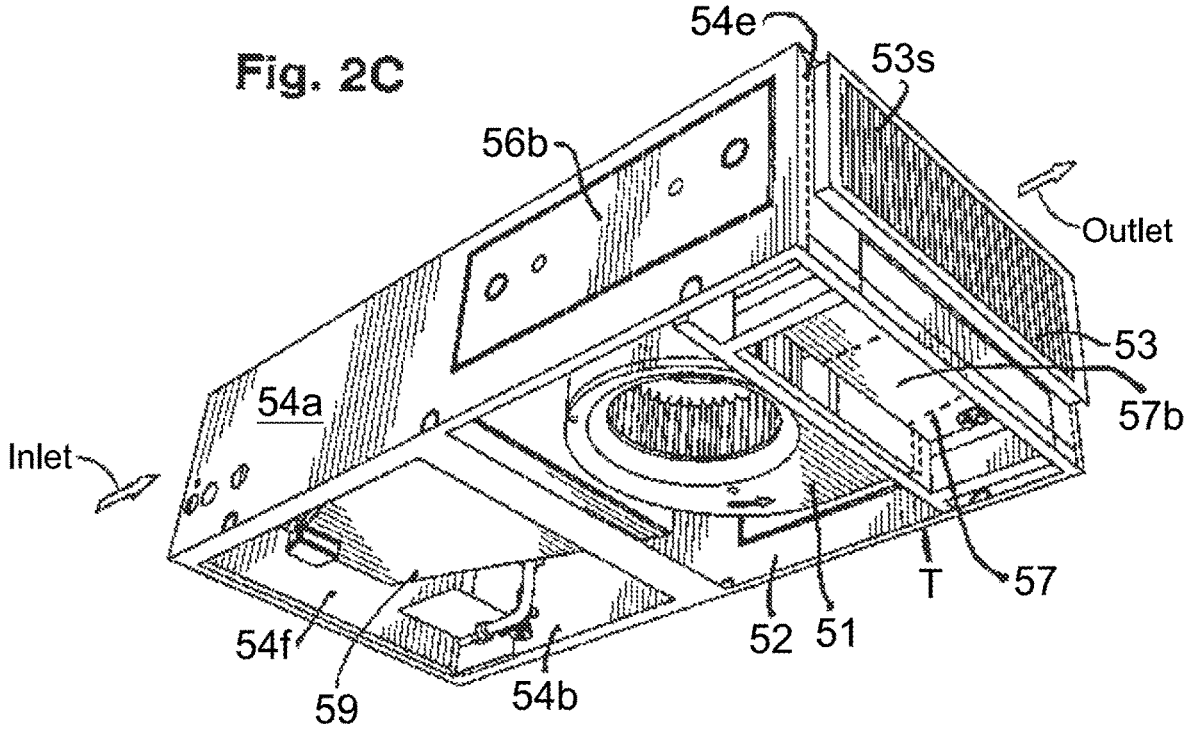
FIG. 2C is bottom view, with a bottom part removed, of the air system of FIG. 2A according to an embodiment.
Figure 2D:
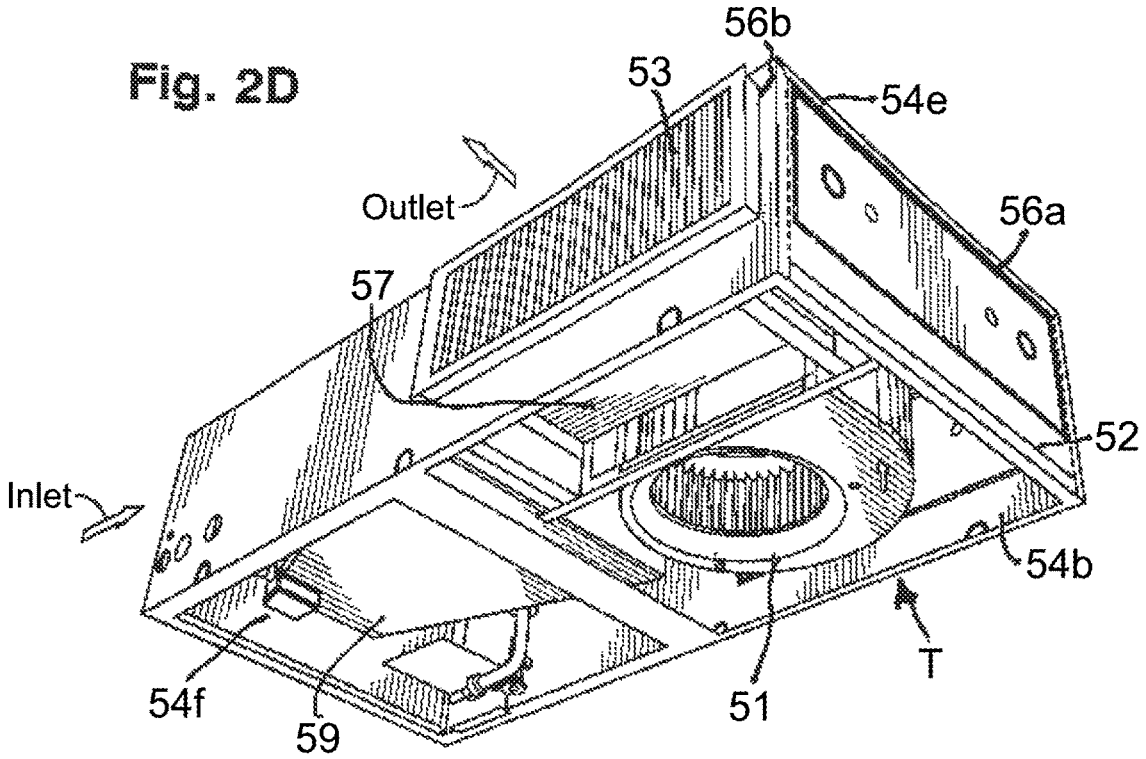
FIG. 2D is a bottom perspective view, with a bottom part removed, of an air system with an enclosure according to an embodiment.
Figure 2E:
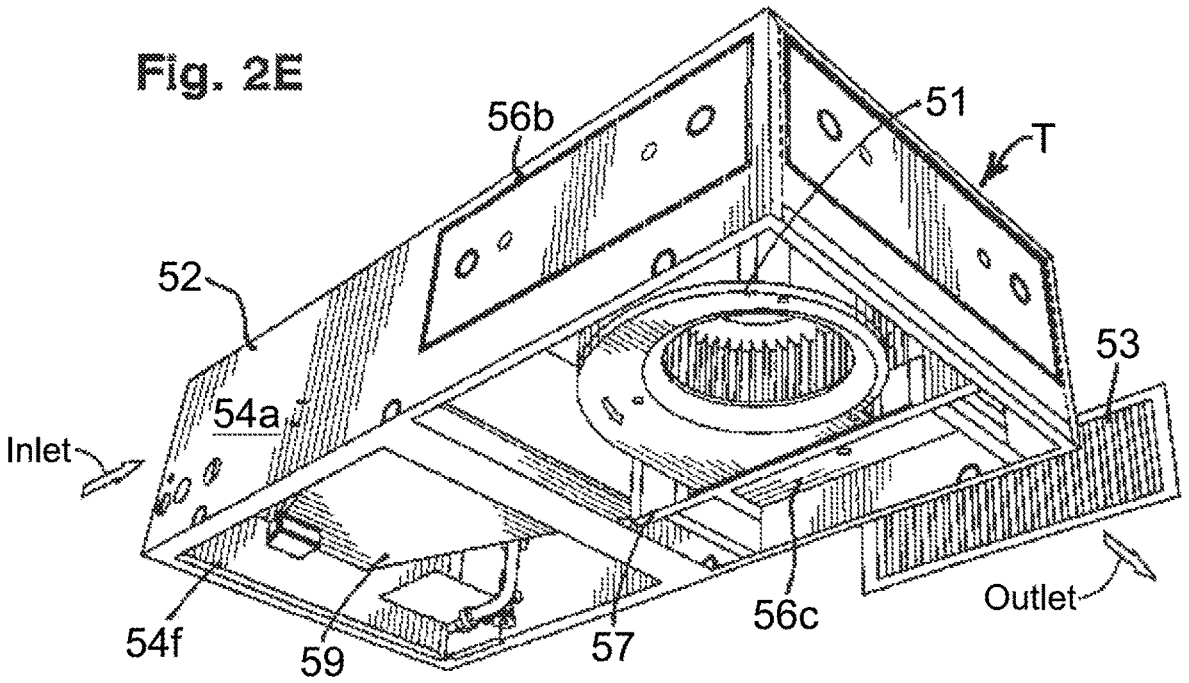
FIG. 2E is a bottom perspective view, with a bottom part removed, of an air system according with an enclosure according to an embodiment.

FIGS. 2A-2E show an air system T that includes an enclosure 52 according to another embodiment. The enclosure 52 includes side walls 54*a*, 54*b*; a top wall 54*c*, a bottom wall 54*d*, a front end wall 54*e*, and rear end wall 54*f*. In the embodiment, a coil system 59 and a blower system 51 are mounted within the enclosure 52. The blower system 51 may be oriented and located so that it blows air out from a selected one of a plurality of possible openings created by removing sections 56*a*, 56*b*, or 56*c*. As shown in FIGS. 2A and 2B, the blower system 51 blows air out of the opening created by removing section 56*a*. As shown in FIG. 2D, the blower system 51 is oriented to blow air out of the opening created by removing section 56*b*. As shown in FIG. 2E, the blower system 51 is located to blow air out of the opening created by removing section 56*c*.

It is within the scope of the present disclosure to cover and/or fill any hole, slit, slot, indentation, valley, passageway, or perforation ("holes, etc.") used to facilitate the removal of a section which is selectively removed to provide an opening at a desired location in an enclosure. Covers may include an interior cover, an exterior cover, or both. Covers can include a flexible or stiff panel or piece of material (all referred to as "covers," e.g., wood, cloth, fabric, plastic, fiberglass, metal, sheet metal, foil, tape, cardboard, or paper) that is disposed so that holes, etc. are covered or filled to prevent the passage of air therethrough. The covers remain in place over one section's holes etc. when another section is chose to be opened so that, as air is blown through the selected opening, air does not flow out through the holes, etc. related to the non-selected section. Any suitable structure, fastener, releasably cooperating fastener material, connector, tape, glue, adhesive, friction fit, snap fit, or mating joint fit, may be used to maintain a cover in place. A cover may be on the interior of an enclosure or on the exterior, or covers may be used on both the interior and the exterior.

Optionally, instead of a section that itself is completely removable from a wall of an enclosure, the necessary 'opening' for providing an air exit from the enclosure can be provided by a hole or series of or plurality of holes, etc. which are covered and/or filled and then, to provide the opening, the cover and/or filler is removed, thereby opening the holes, etc. to air flow.

As shown in FIG. 2A, perforations 56*p* around section 56*b* are initially covered by a cover, plate, or panel 55 on the interior of the enclosure 52 which is held in place by four items 55*a* of releasably-cooperating fastener material (e.g., but not limited to hook-and-loop fastener material or material like VECLRO (registered trademark), with a part on the panel 55 and part on the interior surface of the enclosure 52. The panel 55 may be removed by disengaging the items 55*a*. Such a panel 55 may be used on the exterior of an enclosure. Any suitable connectors, fasteners, friction fit, snap fit, or mating joint fit, or adhesives, such as tape or glue, can be used to hold the covers, etc. in place.

FIG. 2B shows the air system T on a support V that is mounted to a ceiling N and a wall Q. An opening, resulting when a section (not shown) has been removed, is in fluid communication with the blower system 51 so that air exits the enclosure through the opening. Optionally, a grill 53 or similar structure is used over the opening. The grill 53 may or may not have immobile or movable louvers or vanes 53*s* (see FIGS. 2A and 2C).

As shown in the embodiment of FIG. 2C, the blower system 51 is in fluid communication with a structure 57 which can serve as a mount and/or stabilizer for the blower system 51 and provide an air passageway 57*b* between the blower system 51 and a selected outlet opening, e.g., the outlet opening over which the grill 53 is located. As shown in FIGS. 2D and 2E, the structure 57 can be mounted adjacent any chosen opening to assist in the location and securement of the blower system 51 in a desired orientation.

FIGS. 3-6 illustrate some exemplary embodiments of air systems, each including an enclosure as discussed herein. The illustrated air systems have different coil orientations, each with a plurality of possible openings and selectively removable sections for a blower system to exhaust air from an enclosure. Each air system in FIGS. 3-6 may have a pan-coil combination 500 with a pan 502 and a coil 504. A coil closure plate 506 mounted on top of the coil 504 prevents air from flowing either out from a space 508 between two sides 510 and 512 of the coil, or into the space 508 from outside the coil, i.e., the closure plate 506 prevents air from bypassing conditioning vanes 514 in each side of the coil 504.

Figure 3:
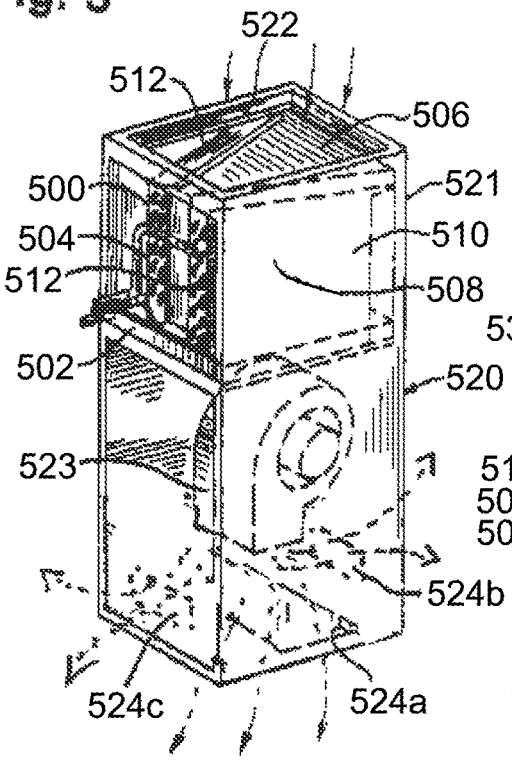
FIG. 3 is a perspective view of an air system with an enclosure according to another embodiment.

As shown in FIG. 3, an upright "downflow" system 520 has an enclosure 521 with a coil-pan combination 500 mounted at the top thereof adjacent an air inlet opening 522. Air flows into the opening 522; down to the sides of the coil 504; through its vanes 514; through an opening (not shown) in the pan 502; to a blower 523; and is then blown out of the enclosure 521. As shown, air is blown out an opening 524*a*. Additional opening sections 524*b* and 524*c* are provided so that a desired opening (or openings) may be chosen for a particular installation. As noted, and as shown in this and other figures, openings provided the enclosure discussed herein may be of different sizes, shapes, and areas, e.g., as opening sections 524*a*-524*c* in FIG. 3, or they may be the same. Also, it is within the scope of the present disclosure for a blower to be mounted in a particular direction or orientation with respect to a chosen opening, such as shown and discussed with respect to FIGS. 2C-2E. Alternatively, the blower can remain in one position within a portion of an enclosure and be in communication with multiple opening sections, and remain in the position no matter which opening is selected, such as with the blowers shown in FIGS. 3-6. Optionally, for any system according to the present disclosure, a blower is provided on the exterior of the enclosure.

Figure 4:
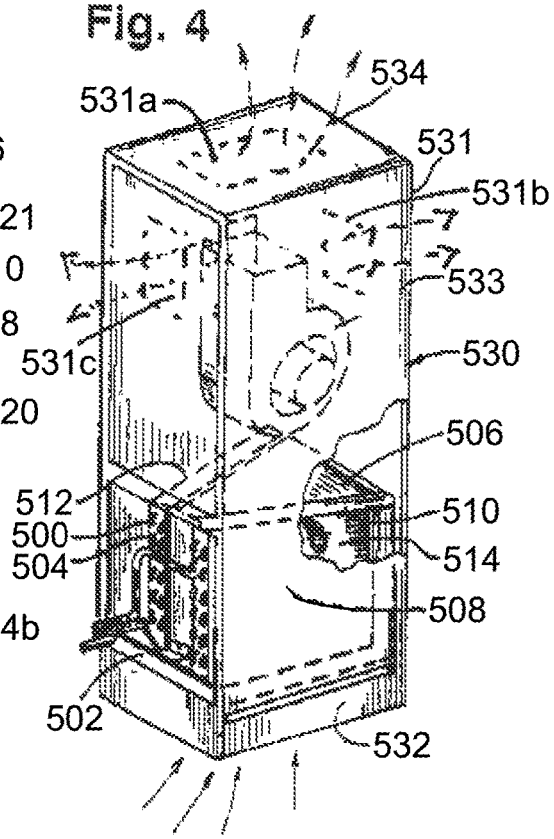
FIG. 4 is a perspective view of an air system with an enclosure according to another embodiment.

As shown in the embodiment of FIG. 4, the coil-pan combination 500 is utilized in an upright "upflow" system 530. Air flows into an air inlet opening 532 in an enclosure 531 as discussed herein and through an opening (not shown) in the pan 502 into the space 508 in the interior of the coil-pan combination 500. A closure plate 506 prevents the air from flowing out from the top of the coil-pan combination 500. The air flows through the vanes 514 on both sides of the coil 504. The conditioned air 534 then flows upwardly to a blower 533 which propels the conditioned air out of the enclosure 531 through an opening 531*a*. As shown, air is blown out the opening 531*a*. Additional removable opening sections 531*b* and 531*c* are provided so that a desired opening (or openings) may be chosen for a particular installation.

Figure 5:
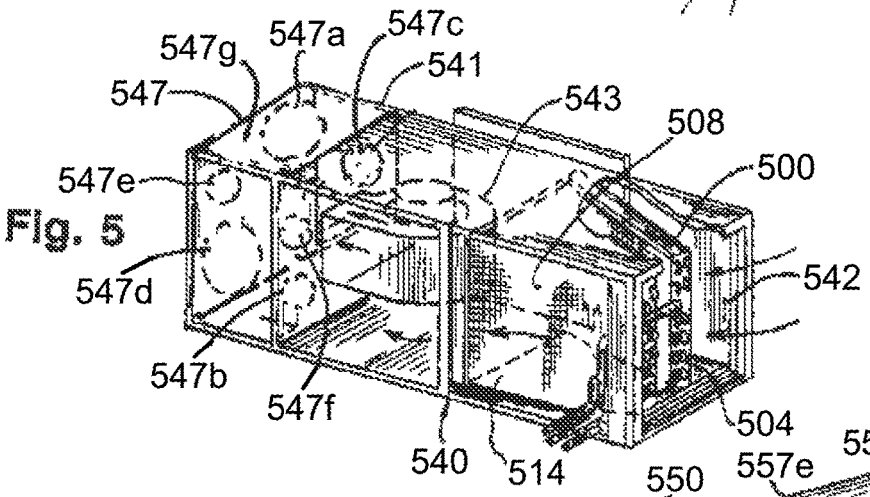
FIG. 5 is a perspective view of an air system with an enclosure according to another embodiment.

In an air system 540 according to the embodiment shown in FIG. 5, air flow is horizontal through the system from one end to the other (right to left as shown in FIG. 5). Air flows into an air inlet opening 542 in an enclosure 541 as discussed herein to a coil-pan combination 500. The air then flows through the vanes 514 of the coil 504 into the space 508 between the coil sides and then to a blower 543 which propels the air into an exit structure 547 as discussed herein and then out from the enclosure 541 via the exit structure 547. A removable side wall may provide access to the interior of the enclosure 541. The exit structure 547 may include a plurality of removable sections 547*a-f*, any one of which or any combination of which can be selectively removed to provide an exit for air propelled by the blower 543. The exit structure 547 can be formed integrally with the rest of the enclosure 541, or it can be connected to the enclosure 541 with, for example, connectors, fasteners, adhesives, welding, fastener material, releasably cooperating fastener material, gluing, rivets, friction fit, snap fit, mating joint fit, and/or tape, etc. As shown in the embodiment, an end 547*g* of the structure 547 has two removable sections 547*e* and 547*f*. It is within the scope of the present disclosure for any part or wall of any enclosure discussed herein to have any desired number of removable sections.

Figure 6:
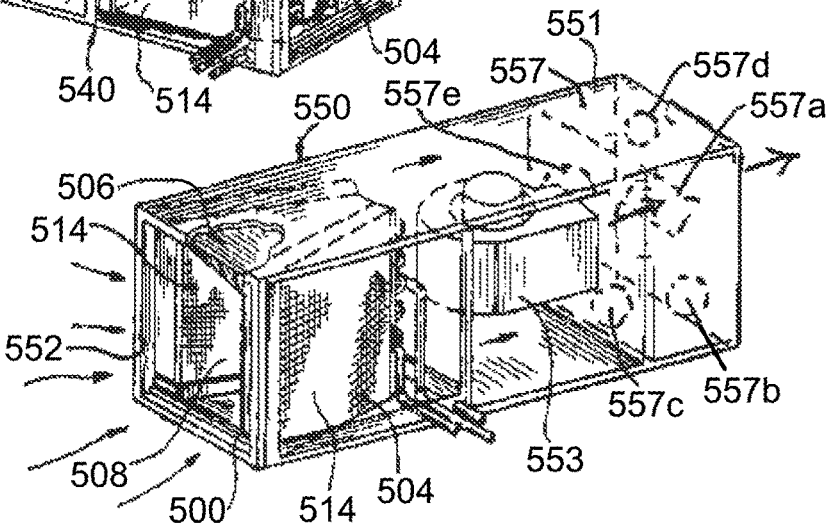
FIG. 6 is a perspective view of an air system with an enclosure according to another embodiment.

FIG. 6 illustrates an embodiment of an air system 550 including an enclosure 551 as discussed herein and an exit structure 557. As shown in FIG. 6, air initially flows through an air inlet opening 552 into the space 508 of the coil 504 of the coil-pan combination 500. Due to the fit of the combination in the enclosure 551, and due to the closure plate 506, the air flows through the coil's vanes 514 to a blower 553 which blows the conditioned air to the exit structure 557, and thus from the enclosure 551 through an opening 557*a*. Additional removable opening sections 557*b-e* may be provided in the walls of the structure 557.

In each of the air systems shown in FIGS. 3-6, the coil-pan combination 500 can fit tightly in the system enclosure so that substantially all of the air to be conditioned must flow across the coil's vanes rather than around the coil bypassing the vanes.

Figure 7A:
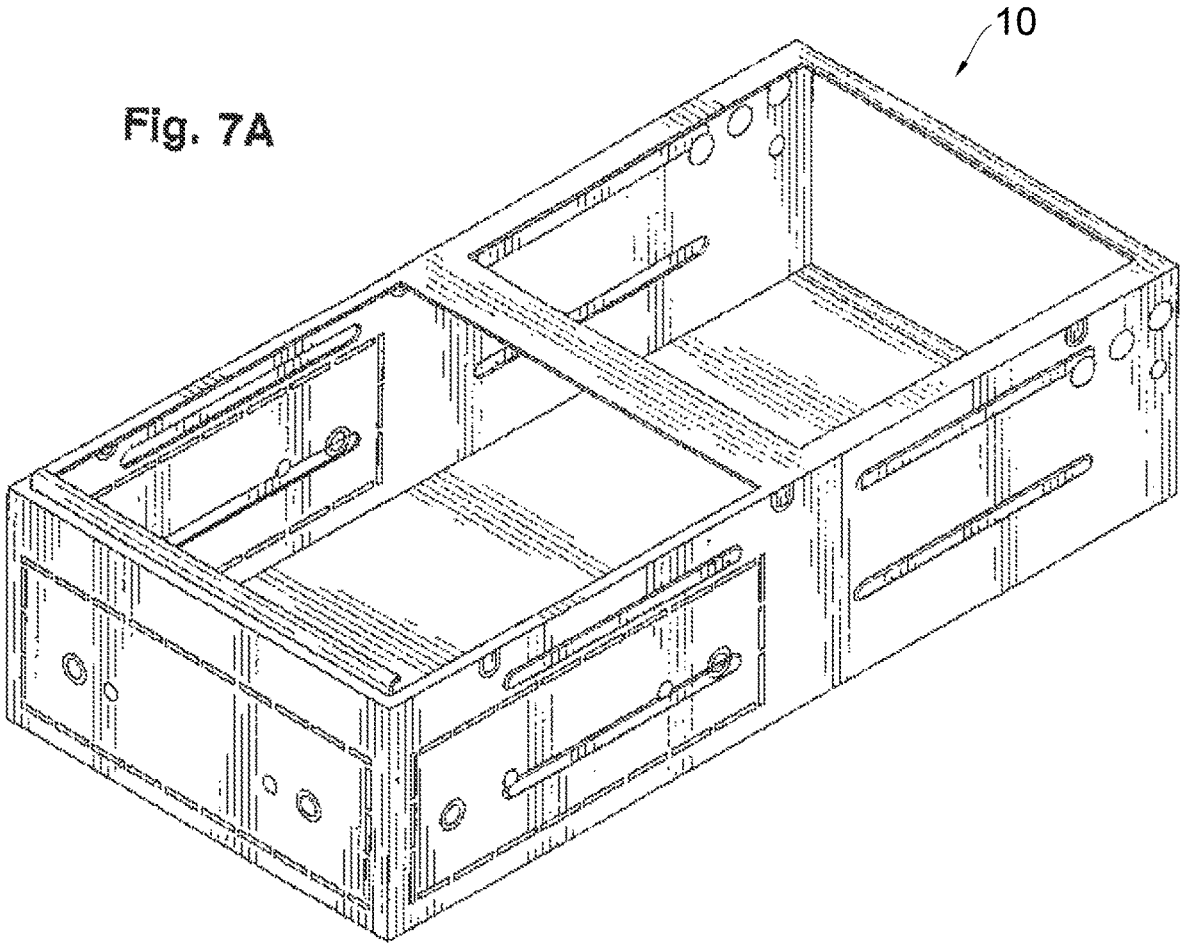
FIG. 7A is a perspective view of an enclosure according to an embodiment.
Figure 7B:
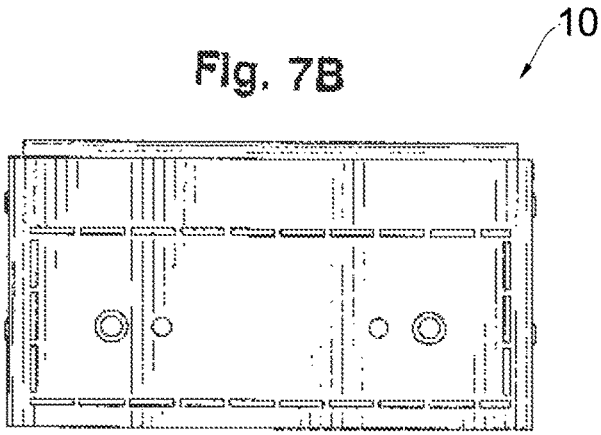
FIG. 7B is a front view thereof.
Figure 7C:
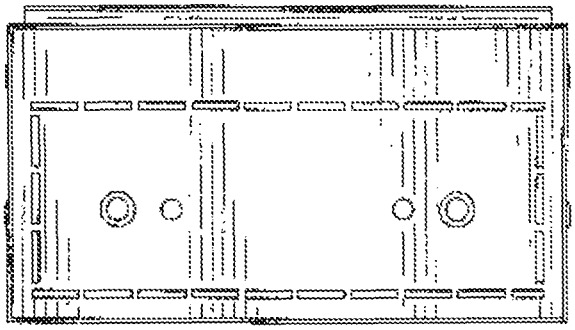
FIG. 7C is a rear view thereof.
Figure 7D:
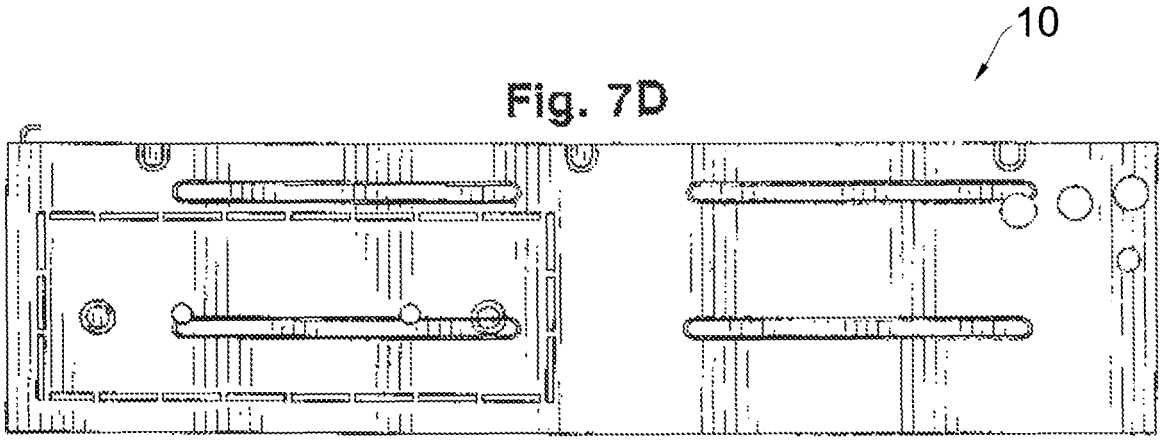
FIG. 7D is a right side view thereof.
Figure 7E:
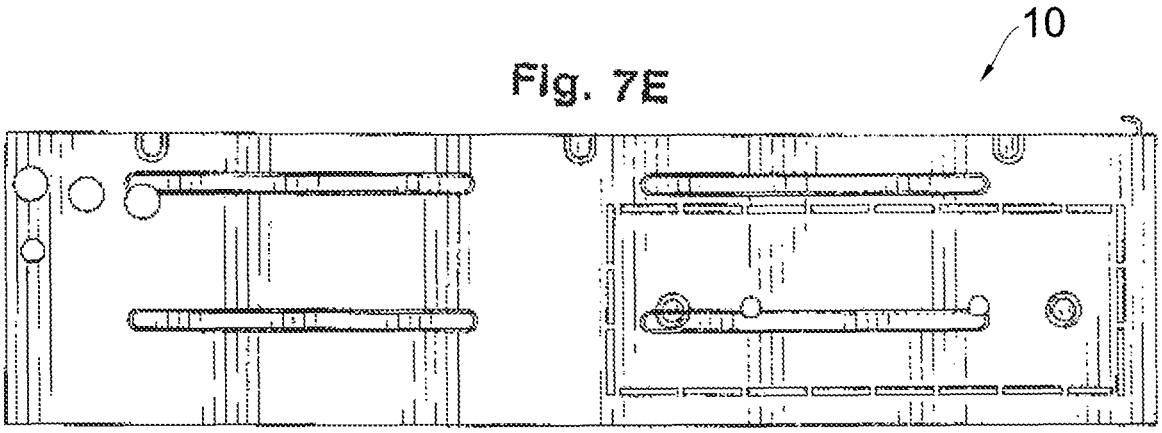
FIG. 7E is a left side view thereof.
Figure 7F:
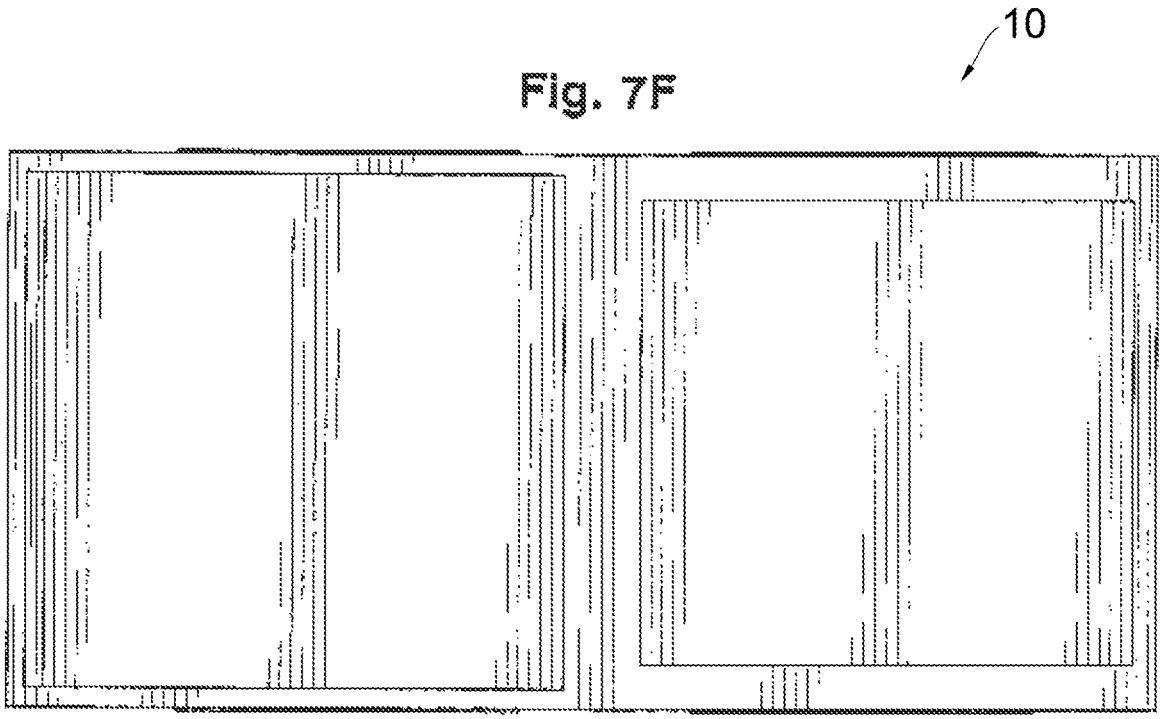
FIG. 7F is a top view thereof.
Figure 7G:
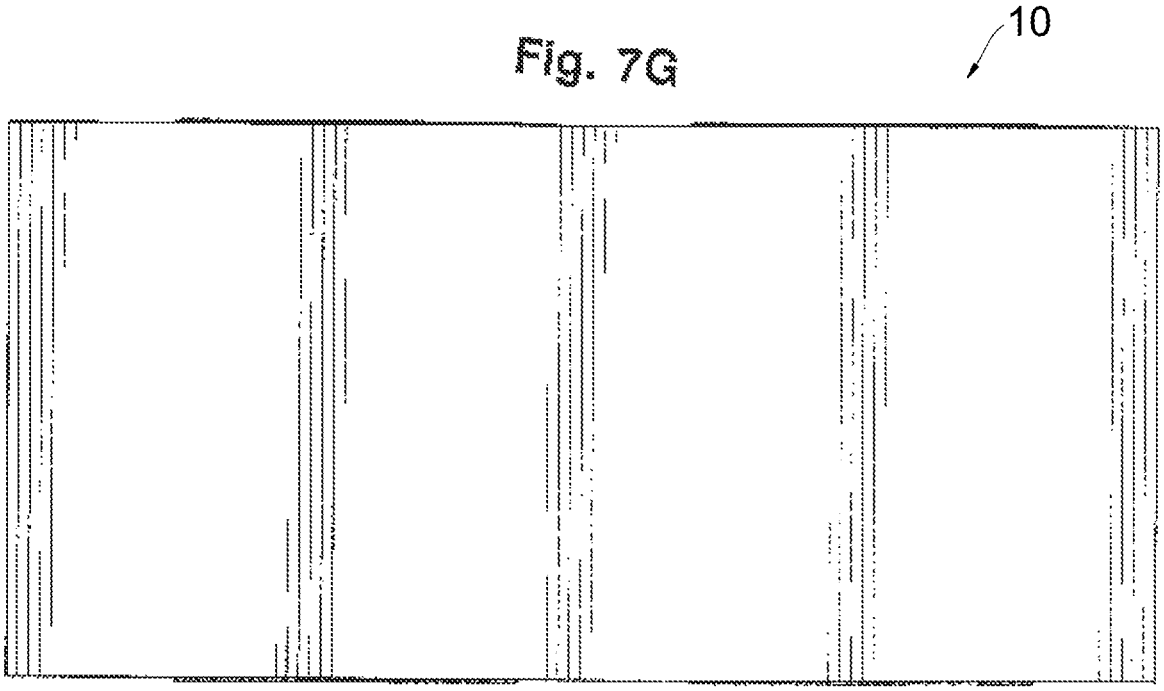
FIG. 7G is a bottom view thereof.

FIGS. 7A-7G illustrate different design views of the enclosure 10 according an embodiment. FIG. 7A is a perspective view of the enclosure 10. FIG. 7B is a front view of the enclosure 10. FIG. 7C is a rear view of the enclosure 10. FIG. 7D is a right side view of the enclosure 10. FIG. 7E is a left side view of the enclosure 10. FIG. 7F is a top view of the enclosure 10. FIG. 7G is a bottom view of the enclosure 10.

Figure 8:
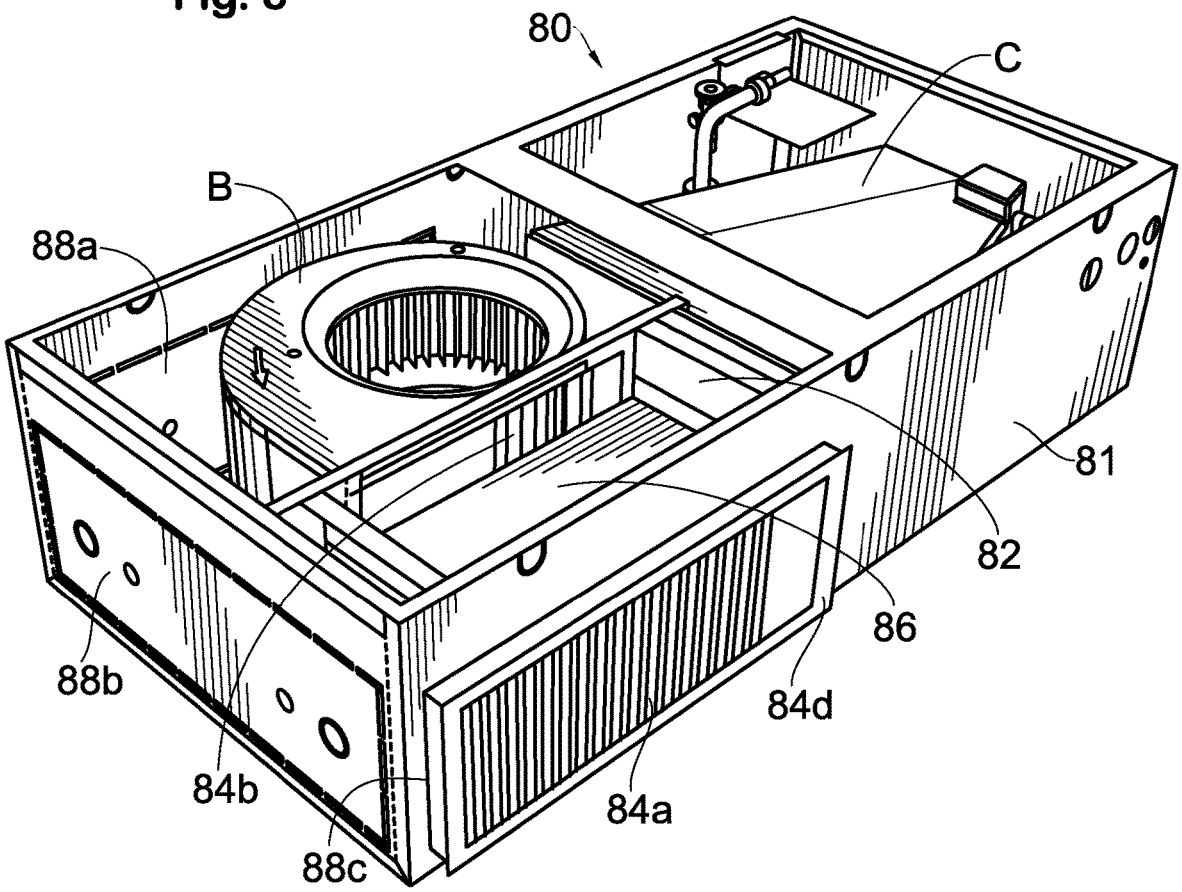
FIG. 8 is a perspective view of an air system according with an enclosure according to another embodiment.

FIG. 8 shows an air system 80 according an embodiment that includes an enclosure 81 as discussed herein, as well as an auxiliary structure 82. A blower system B blows air from a coil system C to and through the auxiliary structure 82, and thus out of an opening 88*c* of the enclosure 81. Optionally, additional opening sections 88*a* and 88*b* are provided which may be used selectively. The auxiliary structure 82 includes an exterior grill 84*d* with movable air-directing vanes 84*a* and interior air-directing movable vanes 84*b*. Optionally a replaceable filter 86 may be mounted within the structure 82. The vanes can be positioned to shut off air flow.

The present disclosure encompasses a method of creating an air flow passageway in any of the air systems discussed herein. The method may include selectively removing at least one of a plurality of removable opening sections (e.g., 16*a*-16*e* in FIGS. 1*a*-1*c*) from one or more walls of an enclosure (e.g., 10 in FIGS. 1*a*-1*c*) to provide an air flow passageway through the one or more walls so that air can flow out of the enclosure via the air flow passageway. In some embodiments, the removable opening sections (e.g., 16*a*-16*e* in FIGS. 1*a*-1*c*) are formed integrally with the enclosure, and the method involves permanently removing at least one removable opening section. In some embodiments, the at least one removable opening section (e.g., 16*a*-16*e* in FIGS. 1*a*-1*c*) is permanently removed via a facilitating structure (e.g., 16*f* in FIGS. 1*a*-1*c*) that comprises at least one of perforations, indentations, valleys, areas of lessened thickness, material that is less stable than material of the enclosure, and material that is weaker than material of the enclosure.

In other embodiments of the method, the removable opening sections (e.g., 16*a*-16*e* in FIGS. 1*a*-1*c*) are detachably connected to the enclosure (e.g., 10 in FIGS. 1*a*-1*c*). The method in these embodiments comprises removing at least one removable opening section e.g., 16*a*-16*e* in FIGS. 1*a*-1*c*) via a fastener. The fastener may comprise at least one of tape, glue, adhesive, a hook-and-loop system, friction fit, snap fit, and mating joint fit, as discussed herein.

The present invention encompasses, by way of example and not by way of limitation, the subject matter, inter alia, disclosed in the following paragraphs.

Any and every air system and any and every part thereof disclosed herein, including, but not limited to, any system shown on any drawings figure or figures herein and/or described in the text herein.

Any and every air handling enclosure disclosed herein, including, but not limited to, any shown on any drawings figure or figures herein and/or described in the text herein.

Any and every method disclosed herein for using an air system and/or enclosure and/or structure or multiple such systems.

Any and every method disclosed herein for using an air system and/or an enclosure to handle air, treat air, move air, heat air, cool air, or any combination of these.

An enclosure for enclosing a blower for blowing air, the enclosure including multiple possible exit openings, each possible exit opening having an opening member selectively removable so that the opening is opened for air flow, or a hole or holes initially blocked to flow that are selectively opened to flow.

An air system including an enclosure for enclosing a blower for blowing air, the enclosure including multiple possible exit openings, each possible exit opening having an opening member selectively removable so that the opening is opened for air flow, or a cover selectively removable to permit air flow.

An air system as in the foregoing paragraph with an air treatment coil, a pump for pumping water or some other heat exchange fluid through the coil, the water or other heat exchange fluid being cold or hot; and, optionally, a cold water source for providing cold water to the coil or a heated water source for providing hot water for the pump to pump to and through the coil.

An air system as discussed herein with a pump, the air system including an enclosure, the pump on the enclosure or the pump within the enclosure, and optionally the system including a coil and the pump on a coil or within a portion of a coil or encompassed by a part or parts of a coil, or between parts of a coil.

An enclosure as discussed herein with a coil, the coil having at least one heated fluid pathway and at least two cooling fluid pathways, the heated fluid pathway among, between, encompassed by, or surrounded by portions of cooling fluid pathways, and/or the heated fluid pathway located as such is located in any of drawing figure herein.

A method using an enclosure as discussed herein.

An air system for treating air, the air system for selectively treating air to cool air or to treat air to heat air, and the system having a coil.

A method for heating air or for cooling air using a system as discussed herein.

An enclosure with removable opening sections, one or more or all of which have a removable cover.

An enclosure with hole(s) selectively openable to provide an air flow passage.

Although several specific embodiments have been illustrated in the accompanying drawings and describe in the foregoing specification, it will be understood by those of skill in the art, who have the benefit of the new knowledge of the present invention, that additional embodiments, modifications and alterations may be constructed from the principles disclosed herein.

The word "comprising" is used in its non-limiting sense to mean that items following the word are included, but items not specifically mentioned are not excluded, and the indefinite article "a" does not exclude the possibility that more than one of the elements is present, unless the context clearly requires that there be one and only one of the elements.

What is claimed is:

1. An air system comprising:

an enclosure comprising walls, wherein two or more of the walls each comprise a removable wall section, wherein each of the removable wall sections is selectively removable to create an enclosure air outlet;

a blower comprising a blower air outlet; and an auxiliary structure configured for mounting the blower within the enclosure, wherein the auxiliary structure comprises an auxiliary air passageway, wherein the blower is connected to the auxiliary structure such that the blower air outlet is aligned with the auxiliary air passageway, wherein the auxiliary structure is configured to connect to the enclosure adjacent to each of the walls comprising the removable wall sections thereby permitting the auxiliary structure to be connected to the enclosure adjacent to a selected one of the walls comprising the enclosure air outlet when a selected one of the removable wall sections is removed, and wherein the auxiliary structure separates the blower air outlet and the enclosure air outlet and the auxiliary air passageway extends between the blower air outlet and the enclosure air outlet when the auxiliary structure is connected to the enclosure adjacent to the selected one of the walls comprising the enclosure air outlet.

2. An air system comprising:

an enclosure comprising walls, wherein two or more of the walls each comprise a removable wall section, wherein each of the removable wall sections is selectively removable to create an enclosure air outlet; and a blower comprising a blower air outlet;

an auxiliary structure comprising structural members and an auxiliary air passageway, wherein the blower is connected to the structural members such that the blower air outlet is aligned with the auxiliary air passageway, wherein the structural members are configured to connect to the enclosure adjacent to each of the walls comprising the removable wall sections thereby permitting the auxiliary structure to be connected to the enclosure adjacent to a selected one of the walls comprising the enclosure air outlet when a selected one of the removable wall sections is removed, and wherein the auxiliary structure separates the blower air outlet and the enclosure air outlet and the auxiliary air passageway extends between the blower air outlet and the enclosure air outlet when the auxiliary structure is connected to the enclosure adjacent to the selected one of the walls comprising the enclosure air outlet.

3. The air system according to claim 2, wherein each of the removable wall sections is defined by at least one of perforations, indentations, valleys, areas of lessened thickness, material that is less stable than material of the enclosure, and material that is weaker than material of the enclosure.

4. The air system according to claim 2, wherein each of the removable wall sections is detachably connected to the enclosure via a fastener.

5. The air system according to claim 4, wherein the fastener consists of at least one of tape, glue, adhesive, a hook-and-loop system, friction fit, snap fit, and mating joint fit.

6. The air system according to claim 4, wherein each of the removable wall sections comprises at least one of a cover, a plug, and a filler.

7. An air system comprising:

an enclosure comprising walls, wherein two or more of the walls each comprise a removable wall section, wherein each of the removable wall sections is selectively removable to create an enclosure air outlet;

a blower comprising a blower air outlet;

an auxiliary structure configured for mounting the blower within the enclosure, wherein the auxiliary structure is configured to connect to the enclosure at different locations within the enclosure thereby permitting the auxiliary structure to be connected to the enclosure adjacent to a selected one of the walls comprising the enclosure air outlet when a selected one of the removable wall sections is removed, and wherein the auxiliary structure separates the blower air outlet and the enclosure air outlet and directs the blower air outlet toward the enclosure air outlet when the auxiliary structure is connected to the enclosure adjacent to the selected one of the walls comprising the enclosure air outlet.

8. A method of customizing an air system comprising an enclosure comprising walls, a blower comprising a blower air outlet, and an auxiliary structure comprising an auxiliary air passageway, wherein two or more of the walls each comprise a removable wall section, the method comprising:

removing a selected one of the removable wall sections from a selected one of the walls to create an enclosure air outlet through the selected one of the walls; and connecting the auxiliary structure to the enclosure adjacent to the selected one of the walls to thereby connect the blower to the enclosure such that the auxiliary structure separates the blower air outlet and the enclosure air outlet and the auxiliary air passageway extends between the blower air outlet and the enclosure air outlet.

9. The method according to claim 8 wherein:

removing the selected one of the removable wall sections from the selected one of the walls to create the enclosure air outlet through the selected one of the walls comprises cutting or tearing the selected one of the walls along a corresponding series of perforations.

10. The air system according to claim 1, wherein the auxiliary structure further comprises structural members, wherein the blower is connected to the structural members, and wherein the structural members are configured to connect to the enclosure adjacent to each of the walls comprising the removable wall sections and thereby connect the auxiliary structure to the enclosure adjacent to each of the walls comprising the removable wall sections.

11. The air system according to claim 1, wherein each of the removable wall sections is defined by a series of perforations along a corresponding one of the walls.

12. The air system according to claim 11, further comprising cover plates, wherein each of the cover plates is detachably connectable to the enclosure by corresponding fasteners to cover a corresponding series of perforations defining a corresponding one of the removable wall sections.

13. The air system according to claim 2, wherein:

each of the removable wall sections is defined by a series of perforations along a corresponding one of the walls;

the air system further comprises cover plates; and each of the cover plates is detachably connectable to the enclosure by corresponding fasteners to cover a corresponding series of perforations defining a corresponding one of the removable wall sections.

14. The air system according to claim 7, further comprising cover plates, wherein each of the cover plates is detachably connectable to the enclosure by corresponding fasteners to cover a corresponding series of perforations defining a corresponding one of the removable wall sections.

15. The method according to claim 8, wherein the blower is connected to the auxiliary structure such that the blower air outlet is aligned with the auxiliary air passageway.

16. The method according to claim 8, wherein the air system further comprises cover plates each detachably connected to the enclosure by corresponding fasteners to cover a corresponding series of perforations defining a corresponding one of the removable wall sections, and wherein the method further comprises disconnecting a selected one of the cover plates by disengaging the corresponding fasteners to uncover a corresponding series of perforations defining the selected one of the removable wall sections along the selected one of the walls.

17. The air system according to claim 2, wherein the structural members extend along the selected one of the walls comprising the enclosure air outlet when the auxiliary structure is connected to the enclosure.

18. The air system according to claim 7, wherein the auxiliary structure comprises an auxiliary air passageway, and wherein the auxiliary air passageway extends between the blower air outlet and the enclosure air outlet when the auxiliary structure is connected to the enclosure adjacent to the selected one of the walls comprising the enclosure air outlet.

19. The method according to claim 8, wherein the auxiliary structure further comprises structural members, wherein the blower is connected to the structural members, and wherein connecting the auxiliary structure to the enclosure adjacent to the selected one of the walls comprises connecting the structural members to the enclosure adjacent to the selected one of the walls.

20. The air system according to claim 10, wherein the structural members extend along the selected one of the walls comprising the enclosure air outlet when the auxiliary structure is connected to the enclosure.

* * * * *